US005346167A

United States Patent [19]

Smialek

[11] Patent Number: 5,346,167

[45] Date of Patent: Sep. 13, 1994

[54] PEG BOARD HANGER

[76] Inventor: Darrell E. Smialek, 1647 Augusta Way, Casselberry, Fla. 32707

[21] Appl. No.: 92,397

[22] Filed: Jul. 15, 1993

[51] Int. Cl.[5] ..... A47B 96/06

[52] U.S. Cl. ..... 248/222.1; 248/222.1

[58] Field of Search ..... 248/221.2, 220.3, 220.4, 248/221.3, 221.4, 221, 222.1

[56] References Cited

U.S. PATENT DOCUMENTS

| | | | |
|---|---|---|---|
| 2,859,008 | 11/1958 | Zimmer | 248/221.2 |
| 3,227,412 | 1/1966 | Terlinde | 248/221.2 |
| 3,640,497 | 2/1972 | Waki | 268/225 |
| 4,434,960 | 3/1984 | Berry | 248/220.4 |
| 4,441,619 | 4/1984 | Gibitz | 211/60 T |
| 4,441,680 | 4/1984 | Rivkin et al. | 248/220.4 |
| 4,645,154 | 2/1987 | Bly | 248/220.4 |
| 4,674,721 | 6/1987 | Thalenfeld | 248/220.4 |
| 4,688,683 | 8/1987 | Thalenfeld et al. | 211/57.1 |
| 4,714,221 | 12/1987 | Cawrey | 248/221.1 |
| 4,750,700 | 6/1988 | Wade | 248/221.2 |
| 4,762,299 | 8/1988 | Langelier | 248/220.4 |
| 4,889,304 | 12/1989 | Glickman et al. | 248/222.1 |
| 4,928,912 | 5/1990 | Florek | 248/221.2 |
| 5,026,011 | 6/1991 | Hoefkes | 248/220.4 |
| 5,165,640 | 11/1992 | Williams, 3rd | 248/221.2 |

*Primary Examiner*—Ramon O. Ramirez

[57] ABSTRACT

A peg board hanger including a central member or main body and attached adjustable securing devices, constructed in such a way that prevents unintentional removal of the hanger from the peg board when objects placed thereon are removed from the hanger. The central member is formed from wire and can accommodate various configurations. The attached adjustable securing devices are made of wire formed in such a way as to comprise wings projecting from either side of the vertical body of the central member and a rearwardly extending deformable member that engages an aperture of the peg board. The adjustable securing devices are attached to the main body of the hanger by welding, soldering or other means of permanent bonding. The wings and the rearwardly extending deformable member, or loop, are adjustable to accommodate varying peg boards conditions. After adjusting the loop and wings to accommodate the conditions found to exist on the particular peg board, the top "S" bend of the hanger is inserted angularly through a perforation. Then, as the hanger is pivoted bringing the bottom closer to the peg board surface, the loop is then inserted through the aligned perforation creating a firm frictional torsion fit. Once adjusted for the peg board, the hangers can be moved from place to place on the peg board using only one hand and without the need of further adjustment.

8 Claims, 2 Drawing Sheets

PEG BOARD HANGER

BACKGROUND OF THE INVENTION

1) Field of the Invention

The device of this invention resides in the area of peg board and merchandise hangers and more particularly relates to structure to prevent its unintentional removal from the peg board when objects placed thereon are removed from the hanger.

2) Description of the Prior Art

Peg boards are vertically placed perforated boards with a plurality of generally equally spaced apertures running from the front surface through to the rear surface of said board with such apertures generally arranged in horizontal rows and vertical columns. Said apertures are generally of a size from approximately 0.125 inches in diameter to approximately 0.250 inches in diameter. On such peg boards are mounted hangers of various configurations to store tools and other objects while not in use and display merchandise and so forth while still permitting easy access. Said hangers are generally of a size from approximately 0.125 inches indiameter to approximately 0.250 inches in diameter also. When one desires to remove an object that has been placed on a peg board hanger, one lifts, or, as in the case of merchandise hangers, slides then lifts, the object from the hanger. In many instances this action causes the problem of unintentionally having the hanger become disengaged from the peg board and falling. Prior art hangers generally include a base, on which the item rests, and members which pass through apertures in the pegboard which members have rearwardly extending pegs to position and steady the hanger on the peg board. In an attempt to eliminate the problem of unintentional removal, prior art hangers consist of several spring actuated parts, or separate plastic parts, or more than one separate metal part, or resiliant wire with angles at the ends, or devices requiring tools for each attachment or detachment, or devices that work with only a specific configuration of peg board. Prior art has had the disadvantages of either; no means of alleviating unintentional removal; or requiring two hands for each attachment and detachment; or consisting of more than one piece thus requiring two hands for attachment and detachment; or requiring tools for each attachment and detachment; or consisting of numerous separate attached and movable parts increasing manufacturing costs and increasing the likelihood of failure or breakage; or consisting of plastic or other more easily breakable materials; or requiring a peg board with a specific configuration of perforations.

SUMMARY OF THE INVENTION

The invention provides a hanger and securing devices for storing or displaying items on peg boards. The invention is made of wire formed to engage two perforations of the peg board. The central member of the invention is formed to provide an "S" bend to engage one of the two perforations, a vertical body extending below the first perforation and a load carrier arm on which to place stored or displayed items. To the body of the central member is attached securing devices consisting of deformable wings and a rearwardly projecting deformable member all of which are adjustable in order that the hanger may be used and secured to peg board of varying thickness and with perforations of varying diameter. The rearwardly projecting deformable member engages the second perforation of the peg board creating a firm frictional torsion fit and provides security against the unintentional removal of the hanger from the peg board. The deformable wings apply pressure to the front surface of the peg board aiding in both adjustment for varying dimensions of peg boards and providing stability of the hanger against a side to side rotation about its vertical axis.

OBJECTS OF THE INVENTION

It is the object of this invention to provide an improved hanger and method of securing said hanger to peg boards which eliminates the prior art problems of unintentional disengagement of the hanger from the peg board when objects held on the hanger are removed therefrom.

It is further the object of this invention to provide a hanger with attached adjustable securing devices which will enable the hanger to be secured to peg boards of varying thicknesses and with perforations of varying diameter. The attached adjustable securing devices are configured as such that tools be required only to make the initial adjustment to conform to board thickness and perforation diameter when necessary.

It is further the object of this invention to provide a hanger that, once adjusted to conform to board thickness and perforation diameter, requires but one hand to detach and then re-attach to same peg board in a different position.

It is also the object of this invention to accomplish the securing of the hanger to the peg board without the need for numerous separate parts or numerous attached moveable parts, without the use of plastics or other easily breakable materials, and without the need for a peg board with a specific configuration of perforations.

It is further the object of this invention to provide as a member of the attached adjustable securing devices, wings extending on either side of the vertical axis of the hanger that not only functions as part of the adjustment for securing to varying thicknesses of peg board but also to aid in the stabilization of the hanger in preventing a side to side rotation about its vertical axis.

It is still further the object of this invention to enable the hanger to be fabricated from a lighter gage wire as the rearwardly extending member of the attached adjustable device is of such a span that it compensates for the gage of wire of prior art hangers that have been constructed in such a way that the size of the perforation in the peg board dictate the need for a peg of heavy gage to engage and closely approximate filling a perforation in the peg board.

It is even further the object of this invention to provide a hanger with a variety of load carrier arm shapes to hold a plurality of different shaped items thereon.

It is further still the object of this invention to provide a hanger consisting of a central member or main body with attached, adjustable securing devices, which is efficient in operation, economical to manufacture, capable of a long operating life and particularly well adapted for its proposed usage.

DESCRIPTION OF THE PREFERRED EMBODIMENT(S)

As required, detailed embodiments of the device of this invention are disclosed herein, however, it is to be understood that the disclosed embodiments are merely exemplary of the invention which may be embodied in various forms. Therefore, the specific structural and functional details disclosed herein are not to be interpreted as limiting, but merely as a basis for the claims and as a representative basis for teaching one skilled in the art to variously employ the present invention in virtually any appropriately detailed structure.

Figure 1:
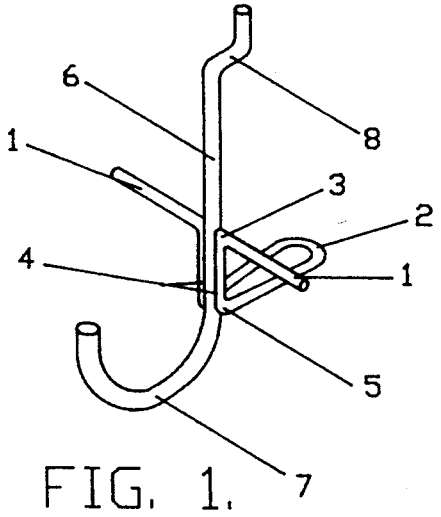
FIG. 1 illustrates a front perspective view of the peg board hanger of this invention.
Figure 2:
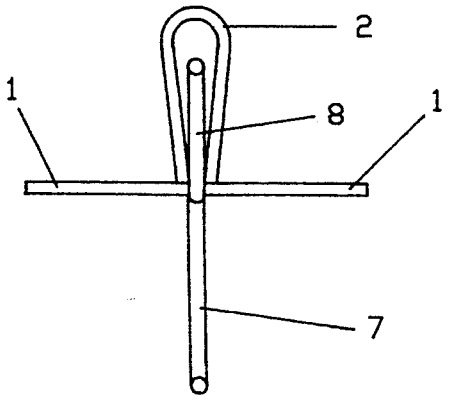
FIG. 2 illustrates a top view of the device of this invention.
Figure 3:
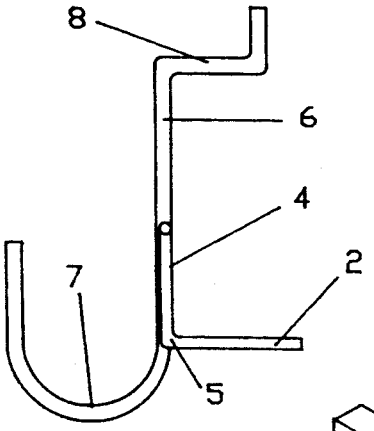
FIG. 3 illustrates a side view of the hanger of this invention.
Figure 4:
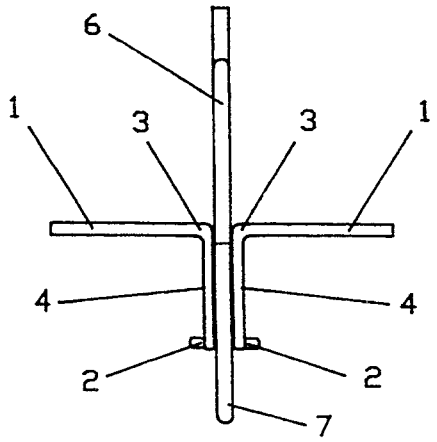
FIG. 4 illustrates a front view of the peg board hanger of this invention.
Figure 9:
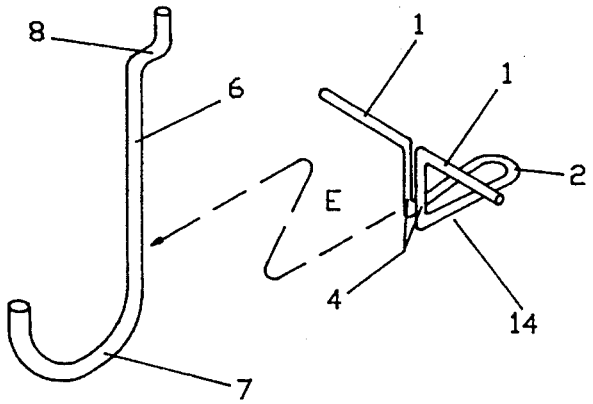
FIG. 9 illustrates a front perspective view of the hanger and the adjustable securing devices separately before attaching.

Referring more in detail to the drawings:

A peg board hanger comprised of wire which includes, as illustrated most prominantly in FIG. 1, FIG. 3, and FIG. 9: an "S" shaped bend 8 to engage a perforation of the peg board, and a main body 6 to which is attached both a load carrier arm 7 and adjustable securing devices 14.

The central member itself is formed from bending a relatively stiff wire of approximately 0.100 inches in diameter to first form the "S" bend section 8 having the wire, when in application, initially span a distance that would lie parallel to the rear surface of the peg board in a vertical orientation ending in a right angle bend toward the front surface of the peg board. The wire comprising the central member then continues spanning a distance that would, when the invention is placed in application, travel through a perforation of the peg board ending once again in a right angle bend that is directly opposed to the original right angle bend and would then cause the wire to lie parallel to the front surface of the peg board in a vertical orientation. The wire then continues forming the body 6 of the hanger laying parallel to the front surface of the peg board in a vertical orientation and covering a span of distance that would accommodate the attachment FIG. 9; arrow E, of the adjustable securing devices. The body 6 of the hanger ends with a connection to a load carrier arm 7, extending angularly outwardly thereof, that may be variously configured to hold a plurality of different shaped items.

Figure 8:
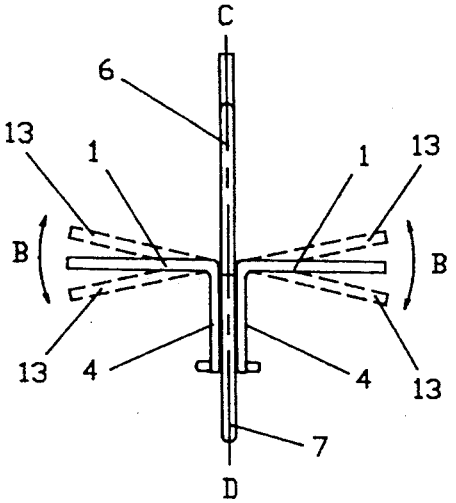
FIG. 8 illustrates a front view of the device of this invention and the up and down adjustment of the wings.

In a preferred embodiment, the attached adjustable securing device 14 is configured from generally deformable wire of approximately 0.060 inches in diameter having horizontal wings 1 extending perpendicular to the vertical axis (FIG. 8, line C-D) of the base member 6 on either side and 180 degrees opposed. Said wings 1 are both, at the nearest proximity to the body 6 of the central member, formed into a ninety degree bend 3 to lie parallel to, and in contact with, the body 6 in a vertical orientation 4. Said contact 4 with the body 6 spans a distance that encompases the attachment by welding, soldering or other means of permanent bonding FIG. 9 arrow E, of the device to the body 6. Said contact 4 is terminated at the point of alignment with a perforation in the peg board by forming both members into a ninety degree bend 5 that would direct the wire on each side to the rear or toward and through the perforation 9 in the peg board 17. In a preferred embodiment, the end of each member meets at a bight forming a loop 2, which is the rearwardly extending deformable member for engaging a second perforation in the peg board.

Figure 5:
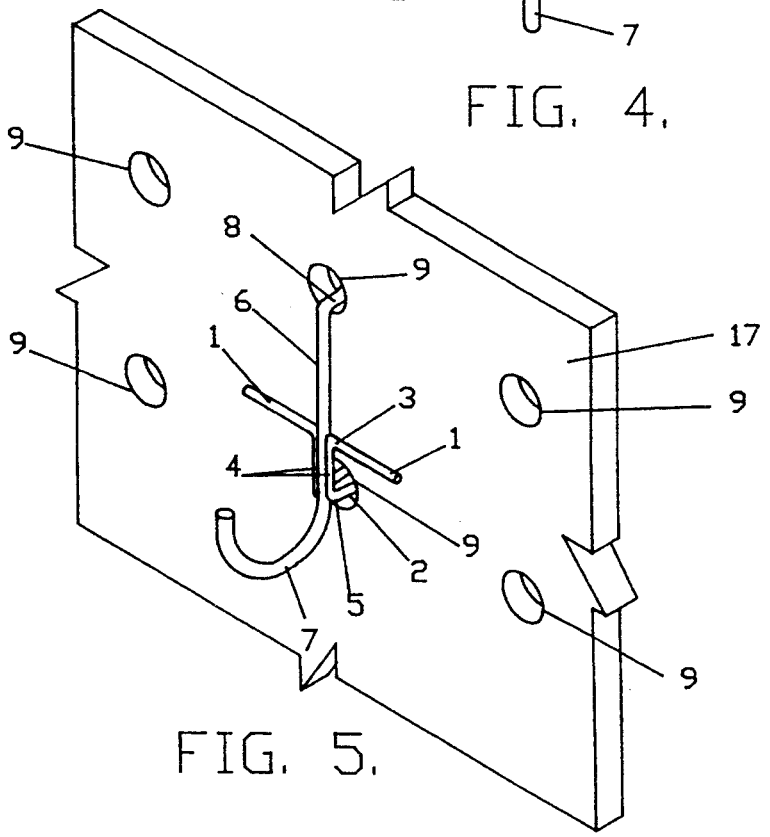
FIG. 5 illustrates a front perspective view of the device of this invention installed on a peg board.
Figure 6:
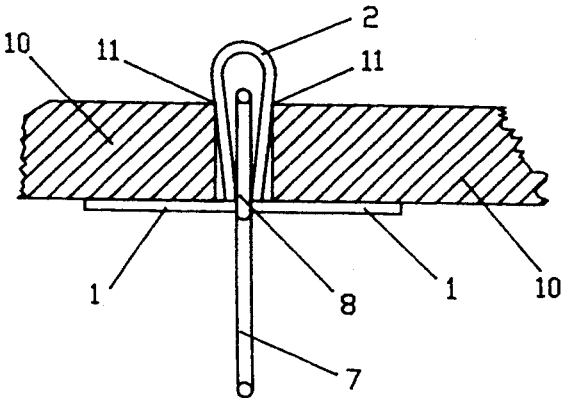
FIG. 6 illustrates a top view of the hanger of this invention installed on a sectional view of a peg board with the attached adjustable securing devices adjusted to meet the conditions of a peg board having a greater thickness with the perforations having a lesser diameter.
Figure 7:
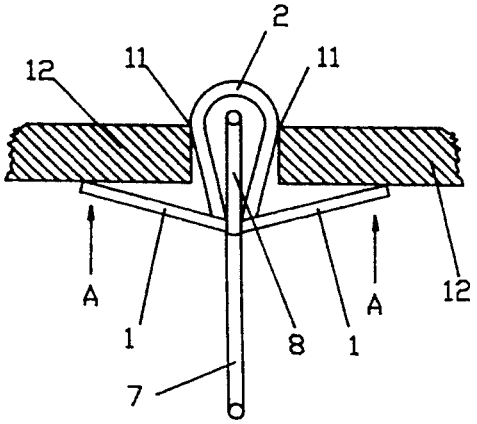
FIG. 7 illustrates a top view of the hanger of this invention installed on a sectional view of a peg board with the attached adjustable securing devices adjusted to meet the conditions of a peg board having a lesser thickness with the perforations having a greater diameter.
Figure 10:
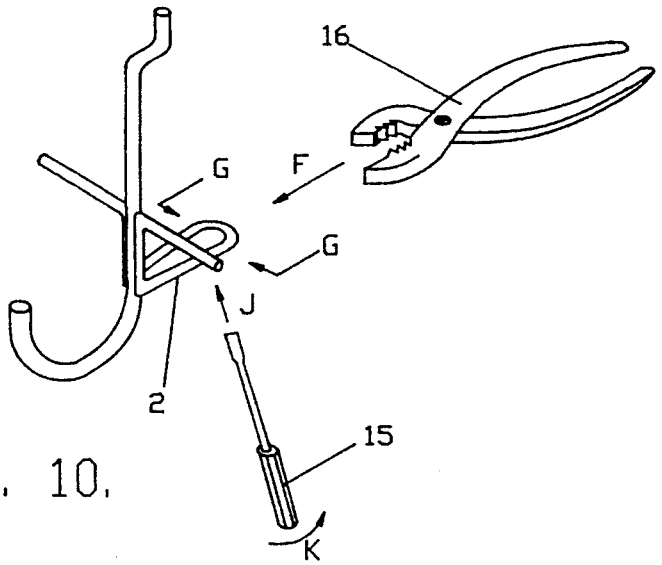
FIG. 10 illustrates a front perspective view of the hanger of this invention and methods for adjustment of the attached adjustable securing devices.

Said loop 2 is configured in such a way that, when necessary, it may be adjusted FIG. 10 by placing a screwdriver 15 through loop 2 as indicated by arrow J and twisting as indicated by arrow K to expand the diameter of loop 2 to accommodate peg board 11 of lesser thickness or with perforations of greater diameter as is shown in application by FIG. 7. The loop may be compressed, as indicated by arrows F and G, with pliers 16 to accommodate peg board 10 of greater thickness or with perforations of lesser diameter as is shown in application by FIG. 6. The wings 1 projecting perpendicular 3 from the main body 6 of the hook can be bent slightly either by hand or with the aid of pliers to either apply greater or lesser pressure against the surface of the peg board, as indicated by FIG. 7 arrows A, aiding in adjustment to compensate for peg board 12 thickness and also offering more stability for the hanger by preventing a side to side rotation about the hanger's vertical axis, line C-D. The wings 1 may also be bent FIG. 8; 13, slightly up or down FIG. 8 arrows B, to avoid overlapping the wings of another hanger if it is desired to place hangers into adjacent perforations of the peg board. After adjusting the loop 2 and wings 1 to accommodate the conditions found to exist on the particular peg board, the top "S" bend 8 of the hanger is inserted angularly through a perforation FIG. 5; 9, and then as the hanger is pivoted bringing the bottom closer to the peg board surface 17 the loop 2 is in then inserted through the aligned perforation creating a firm frictional torsion fit caused by pressure from contact along the side as illustrated in FIG. 6 and FIG. 7 at points 11. Once adjusted for the thickness of the peg board and the diameter of the perforations, the hangers can, with one hand, be moved from one place to another on the peg board without the need of further adjustment.

It should be noted that although the device of this invention has been shown and described herein with reference to preferred embodiments thereof, any design of load carrier arm 7 may be attached to the body of the central member 6 with the intent of accommodating a plurality of various shaped items for storage or display.

Although the device of this invention has been described with reference to preferred embodiments, it will be apparent to those skilled in the art that variations and modifications can be substituted therefore without departing from the principles and spirit of the invention.

What is claimed and desired to be secured by Letters Patent is as follows:

1. A hanger for storage of items, such as tools, and display of merchandise for use with an aperture mounting board having a plurality of apertures, said hanger comprising:

(a) an S-shaped wire member having a body defined by two ends, said body laying generally parallel and in vertical orientation to a surface of the mounting board, with one end engaging a first aperture;

(b) an angularly projecting load carrier attached to the other end of said body; and (c) means attached to said body for securing the body to a second aperture of the mounting board, said means comprises deformable wings extending perpendicular and horizontal from said hanger body parallel to said surface of the mounting board, and a deformable projecting member extending perpendicular and rearwardly from the hanger body engaging said second aperture.

2. The hanger defined in claim 1 wherein said securing means is made in a unitary piece.

3. The hanger defined in claim 1 wherein the projecting member defines a loop.

4. The hanger defined in claim 1 wherein said deformable wings and said rearwardly projecting deformable member are permanently attached to the body of the central member.

5. The hanger defined in claim 1 wherein said load carrier arm is permanently attached to said body.

6. The hanger defined in claim 1 wherein said rearwardly projecting deformable member secures said hanger to said peg board by creating a firm frictional torsion fit of said rearwardly projecting deformable member extending through said second aperture.

7. The hanger defined in claim 1 wherein said deformable wings apply pressure to said surface of said peg board and provide stability to said hanger.

8. The hanger defined in claim 1 wherein said deformable wings and said rearwardly projecting deformable member are adjustable by means of their deformability in order that said hanger may conform to various peg boards.

* * * * *